United States Patent [19]

Suzuki

[11] Patent Number: 4,800,688

[45] Date of Patent: Jan. 31, 1989

[54] BLASTING NOZZLE FOR WET BLASTING MACHINE

[75] Inventor: Akira Suzuki, Gottemba, Japan

[73] Assignee: Fuji Seiki Machine Works, Ltd., Sunto, Japan

[21] Appl. No.: 63,259

[22] Filed: Jun. 17, 1987

Related U.S. Application Data

[63] Continuation-in-part of Ser. No. 805,087, Dec. 4, 1985, abandoned.

[30] Foreign Application Priority Data

Dec. 5, 1984 [JP] Japan ..... 60-183649

[51] Int. Cl.[4] ..... B24C 5/04; B05B 1/04

[52] U.S. Cl. ..... 51/439; 51/427; 239/597

[58] Field of Search ..... 51/410, 427, 439; 239/433, 434.5, 597

[56] References Cited

U.S. PATENT DOCUMENTS

| | | | |
|---|---|---|---|
| 2,606,073 | 8/1952 | Uhri | 51/439 X |
| 2,897,692 | 8/1959 | Beckner et al. | 51/439 X |
| 2,921,748 | 1/1960 | Kane | 239/597 X |
| 2,940,418 | 6/1960 | Penrod et al. | 239/597 X |
| 4,562,095 | 12/1985 | Coulon et al. | 239/597 X |

FOREIGN PATENT DOCUMENTS

| | | | |
|---|---|---|---|
| 971639 | 11/1982 | U.S.S.R. | 51/439 |
| 412330 | 6/1934 | United Kingdom | 51/410 |

OTHER PUBLICATIONS

Fuji Seiki Machine Works, Ltd. brochure re PBD-228F machine.

*Primary Examiner*—Robert P. Olszewski

*Attorney, Agent, or Firm*—Flynn, Thiel, Boutell & Tanis

[57] ABSTRACT

A blasting nozzle structure for wet-blasting of an abrasive slurry, which structure includes a body having substantially parallel first and second passages for flow therethrough of pressurized air and abrasive slurry, respectively. A nozzle member extends longitudinally of the member and defines a longitudinally elongated but narrow slitlike opening which opens transversely from the slurry passage for permitting discharge of a thin curtainlike stream of abrasive material. An air nozzle member is also fixed to the body part and defines a narrow slitlike flow opening threrthrough, the latter extending transversely from the air passage through the slurry passage for directing a thin curtainlike jet of air into the slurry passage directly adjacent the upstream end of the main discharge slit. The discharge slit and the air slit are each elongated parallel with the respective passages so as to have substantially rectangular configurations, whereby the nozzle structure is capable of discharging a thin curtainlike jet of air-slurry mixture, which curtainlike jet is of fairly uniform pressure and slurry concentration throughout the longitudinal extent thereof.

3 Claims, 1 Drawing Sheet

BLASTING NOZZLE FOR WET BLASTING MACHINE

This application is a continuation-in-part of U.S. application Ser. No. 805,087, filed Dec. 4, 1985 now abandoned.

FIELD OF THE INVENTION

This invention relates to a blasting nozzle particularly suited for blasting a liquid-solid particle mixture against a flat platelike member, such as a printed circuit board.

BACKGROUND OF THE INVENTION

In the blasting art, wherein a mixture of liquid and solid abrasive particles is blasted against a surface to effect a desired finishing thereof, it is conventional to provide the blasting nozzle with a shape which corresponds to the desired blasting pattern. For example, when it is desired to effect blasting of a flat rectangular pattern, the nozzle is provided with a cross-sectional shape which substantially corresponds to the pattern to be blasted. However, due to the abrasiveness of the solid particles which are being blasted through the nozzle, it has been observed that the nozzle undergoes rapid wear, and in fact substantial wear has been observed to occur in a matter of a few hours of operation, so that the cross-sectional shape of the nozzle undergoes substantial change. This has been observed even when the nozzle is constructed of a hard alloy. Further, the speed of the slurry (that is, the liquid-abrasive particle media) is not always uniform throughout the cross section of the nozzle in view of the different sectional configuration of the nozzle, and this also affects the uniformity of the media as it is being blasted onto the workpiece. This nonuniformity of flow also creates nonuniformity of wear, which also affects the shape and hence the blasting pattern. Accordingly, obtaining an even and uniform blasting, without encountering excessive nozzle wear, has been a long-standing and significant problem.

In addition, it is desirable to utilize this wet-blasting technique in an attempt to finish printed circuit boards, both to remove burr from the small drilled holes in the boards, and to also finish the surface of the board both before and after the circuit-making process. However, conventional nozzles have demonstrated an inability to provide uniformity of blasting sufficient to meet the requirements for finishing circuit board.

Accordingly, this invention relates to an improved nozzle designed specifically for blasting a wet abrasive slurry, which nozzle is capable of providing a substantially uniform blasting effect over a substantial area, and hence overcome many of the disadvantages associated with the prior nozzle structures. In addition, the improved nozzle is believed to provide such uniform blasting, and is believed capable of doing so over longer periods of time by providing a nozzle which creates more uniform flow velocity therethrough across the cross section thereof and at the same time is believed to experience less wear.

In the improved nozzle of the present invention, the nozzle body has an elongated flow passage extending transversely thereof and through which flows the slurry containing the abrasive particles. The bottom side of this flow passage is defined by angled surfaces which define a substantially V-shaped trough. A nozzle opening formed as an elongated slit communicates with the bottom of this trough, the slit being of narrow width but substantially elongated in the direction of the trough so as to permit discharge therethrough of a stream of slurry which is of a sheetlike configuration, that is, a wide but very narrow jet. An air nozzle number projects into the slurry passage throughout the elongated length thereof, the air nozzle member defining a narrow but longitudinally elongated air slit therethrough, with the tip of this slit being disposed within the V-shaped trough directly adjacent the inner end of the nozzle slit. The air nozzle member discharges a thin high-pressure curtain of air from the tip thereof directly into the bottom of the trough, causing the slurry to be blasted outwardly through the nozzle slit so as to create a thin sheetlike jet for impingement against a workpiece.

Other objects and purposes of the invention will be apparent to persons familiar with structures of this general type upon reading the following specification and inspecting the accompanying drawings.

DETAILED DESCRIPTION

Figure 1:
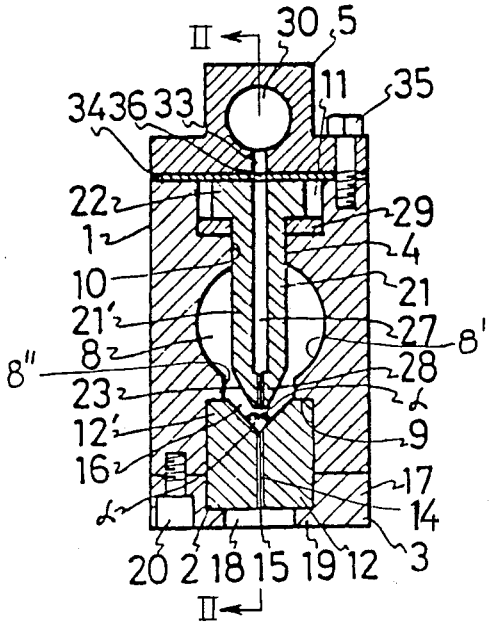
FIG. 1 is a cross-sectional view of the improved nozzle structure of this invention, same being taken substantially along line I—I in FIG. 2.

Referring to the drawings, there is illustrated a nozzle structure according to the present invention. This nozzle structure includes a main body 1 having a discharge nozzle member 2 secured thereto by a securing member 3. An air nozzle member 4 is secured to the main body 1 by means of and in communication with an air inlet body 5.

Considering first the main body 1, this is formed substantially as a cubic or boxlike member having a main slurry passage 8 formed therein, which passage extends longitudinally of the main body 1 throughout a majority of the extent thereof, with the opposite ends of this passage 8 communicating with inlet and outlet openings 6 and 7, respectively, which open outwardly through the opposite end walls of the main body. These inlet and outlet openings are in turn connected to an appropriate circuit whereby a mixture of liquid and solid abrasive particles (hereinafter referred to as a slurry) can be supplied from a tank T by an appropriate pump P into the passage 8.

The passage 8, as illustrated by FIG. 1, is of a generally keyhole-shaped cross section in that it includes an upper substantially cylindrical portion 8' which extends longitudinally of the body, and this cylindrical portion 8' in turn joins to a somewhat narrower slotlike portion 8'' which also projects over a substantial length of the body and opens downwardly through the bottom wall thereof. This bottom portion 8'' is suitably widened out and hence defines downwardly facing shoulders 9. The discharge nozzle member 2 is securely positioned within this widened passage portion 8'' so as to substantially abut against the shoulders 9.

The discharge nozzle member 2 is also constructed substantially as a cubic or boxlike block which extends longitudinally over a majority of the length of the main body 1 so as to hence occupy the length of the slot 8''. This discharge nozzle member 2 is preferably formed from two substantially identical blocklike members 12 and 12' which have the opposed and substantially planar surfaces 13 thereof disposed in abutting engagement with one another. The two blocklike members 12 and 12' are preferably fixedly joined together, such as by bolts or screws (not shown).

Figure 2:
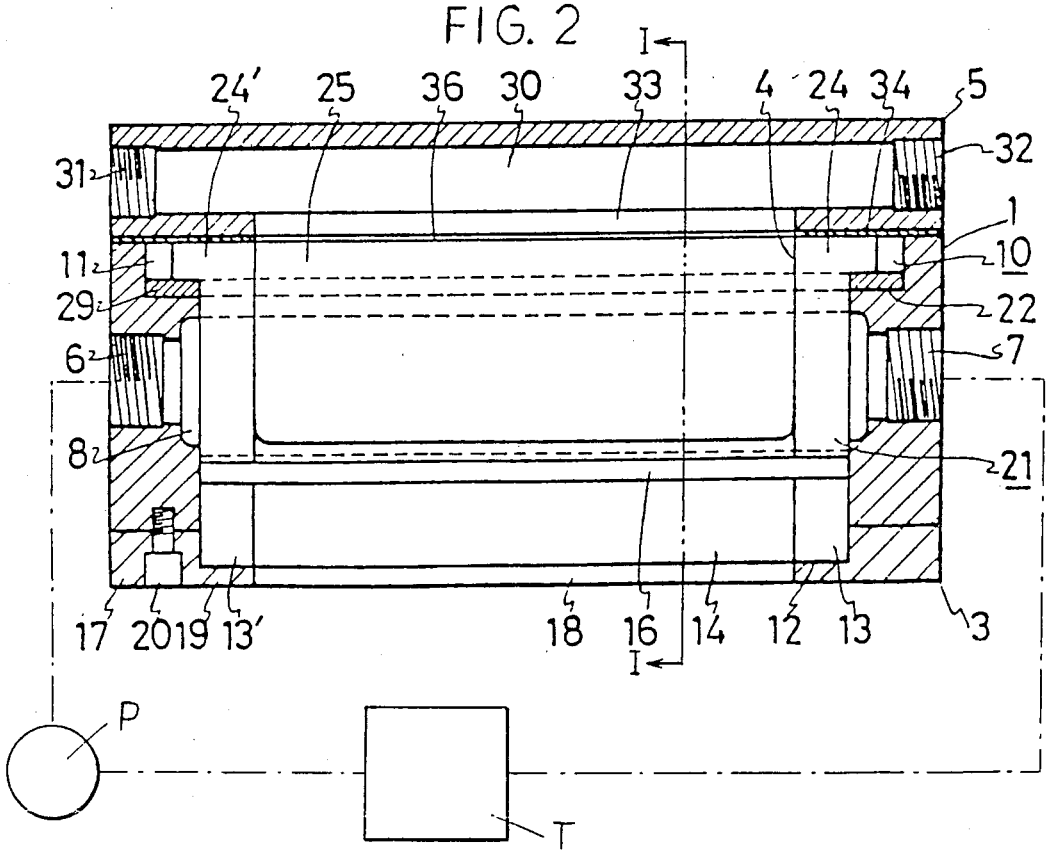
FIG. 2 is a sectional view of the nozzle as taken substantially along line II—II in FIG. 1, and diagrammatically illustrating the attachment of the nozzle in a blasting circuit.

The discharge nozzle member 2 defines a thin slitlike discharge opening or nozzle 14 extending downwardly therethrough, which discharge opening 14 is defined between the opposed contacting surfaces 13, the latter being partially relieved intermediate the ends thereof so as to define the narrow slit. This slit 14 is elongated over a majority of the length of the nozzle member, as illustrated by FIG. 2, with the lower end 15 of this slit effectively functioning as a discharge nozzle for emitting a thin sheetlike spray of slurry.

The nozzle member 2 is fixedly and securely held to and within the main body 1 by means of the securing member 3, the latter comprising a substantially rectangular ring-shaped plate which is secured to the bottom surface of main body 1 by means of suitable fasteners such as screws 20. This securing member 3 has a flangelike shoulder 19 which projects under the nozzle member 2 for securing the latter. A slotlike opening 18 of substantial width is formed in the securing member 3 and extends longitudinally throughout the length of the nozzle member 2 so as to permit the nozzle discharge 15 to freely discharge the slurry against a workpiece.

The upper surface of the nozzle member 2 has a substantially V-shaped channel 16 formed therein so as to function as an inducing section for the slit 14. This inducing section 16 preferably defines an angle of between 60° and 90° between the side walls thereof, and the apex of this inducing section 16 communicates with the upper end of the slit 14. This inducing section 16 extends longitudinally of the nozzle member 2 and hence is in open communication with and effectively defines a portion of the longitudinally elongated slurry passage 8. The channel or inducing section 16 is preferably formed by creating a tapered wall of between 30° and 45° on the corner of each nozzle block 12 and 12'.

Considering now the air nozle member 4, it is of a generally T-shaped cross section and is longitudinally elongated so as to extend over and communicate with the slurry passage 8 over substantially the full extent thereof. This air nozzle member 4 has the main downwardly projecting leg portion thereof disposed so as to project downwardly through a slot 10 as formed in the body 1 so that the air nozzle member projects downwardly into and substantially across the slurry passage 8. The upper or head end of the T-shaped air nozzle member 4 has sidewardly projecting flanges 22 which are accommodated within a longitudinally elongated slotlike cavity 11 which is formed in the upper surface of the main body 1, this cavity 11 being in communication with the slot 10. The head part 22 of the air nozzle member is fixedly secured in the cavity by means of the air inlet body 5, the latter longitudinally overlying the upper surface of the main body 1 and being fixed thereto by fasteners such as screws 35. An appropriate sealing member or gasket 34 is interposed between the bodies 1 and 5, and a similar sealing member or gasket 29 is disposed below the underside of the head part 22.

The air nozzle member 4 defines a narrow slitlike opening 25 which projects vertically downwardly through the air nozzle member 4, with this slit 25 being longitudinally elongated so as to extend over a length of the nozzle member 4 which substantially corresponds to the longitudinal length of the slit 14. This slit 25 includes a wider portion 27 which projects downwardly from the upper surface of the nozzle member and terminates a short distance from the bottom thereof, with this wider slit portion 27 in turn communicating with a narrower slit portion 28 which projects downwardly through the free end of the nozzle member 4.

The air nozzle member 4 is preferably formed from two identical members 21 and 21' which are disposed in directly opposed relationship and are fixedly secured together, as by screws, so as to define the T-shaped member. These two opposed parts 21 and 21' have, adjacent the ends thereof, opposed surfaces 24 and 24' which are disposed in direct abutting contact with one another, which surfaces throughout the remaining length of the members 21 and 21' are relieved so as to define the slit 25.

The lower end of the nozzle member 4 is preferably provided with tapered side walls 23 which project downwardly and inwardly in converging relationship so that the lower or tip end of the nozzle member projects partially downwardly into the channel 16. The slope on these side walls 23, however, is preferably slightly greater than the slope of the walls defining the channel 16 so as to facilitate the flow of the slurry around the tip end of the nozzle member into the channel 16. The narrow slit 28 is aligned directly above the slit 14 and is spaced therefrom by a small distance, which distance is in the range of from 0 to 2 mm.

The air inlet body 5, as illustrated by FIG. 2, has a hole or passage 30 extending longitudinally thereof in generally parallel relationship with the slurry passage 8. This hole has inlet and outlet openings 31 and 32, respectively, at opposite ends thereof for connection to an appropriate pressurized air circuit. Hole 30 communicates with a longitudinally elongated narrow slit 33 which projects downwardly through the body 5 for communication with a similar slit 36 formed in the gasket 34, which slit 36 communicates with the upper end of the slit 25.

The nozzle structure of the invention operates as follows:

The slurry is supplied from the tank T through the inlet 6 into the slurry passage 8, with the slurry flowing longitudinally along this passage, and with the slurry filling the induction channel 16. The slurry as supplied to the passage 8 is a substantially uniform mixture of water and solid abrasive particles, with the slurry being supplied into the passage 8 at a relatively low speed.

At the same time, compressed air is supplied from the delivery side of a compressor (not shown) through the inlet 31 into the air passage 30, from which the pressurized air then flows downwardly through the slit 33 and the nozzle slit 25 so as to be discharged from the narrow air slit 28 in the form of a thin but longitudinally elongated air curtain. The highly pressurized air curtain which is discharged from the narrow slit 28 is directed downwardly into the apex of the induction channel 16 and thence directly into the upper end of the slit 14. Due to this positional and directional relationship of the air curtain as discharged from the slit 28, the slurry which is contained within the induction channel 16 becomes entrained within the air curtain and is forced through the slit 14 and discharged as a blasting jet at the discharge opening 15. In this manner, a very thin but elongated stream of slurry, resembling a curtain, is impinged against a substantially flat workpiece so as to effect uniform abrading and hence finishing of the workpiece surface. The abrasive particles which are picked up from the passage 8 and discharged with the air stream perform a uniform abrading and hence cutting action on the surface of the workpiece.

Since the slurry flowing in the inducing channel 16 is picked up by the compressed air stream and blasted outwardly through the slit 14 by the compressed air, and inasmuch as the slurry is spread longitudinally substantially uniformly along the channel 16, coupled with the uniform air curtain discharged therealong from the slit 28, the ultimate blasting of the slurry curtain as discharged from the slit 15 is substantially uniform with respect to its ratio of particles and water, and is also substantially uniform in this regard throughout the longitudinal (that is, the left-to-right extent in FIG. 2) extent of the jet. Not only does this result in uniform blasting of the workpiece, but it also results in the nozzle undergoing wear at a relatively uniform rate, and hence no significant change in nozzle shape occurs, whereby the uniformity of the blasting effect is maintained longitudinally across the width of the blasting area even as the nozzle undergoes wear.

The improved nozzle of this invention, and the desirable results achieved thereby, are provided when the nozzle, in a preferred embodiment, has the following dimensional relationships: the slurry discharge opening 14 has a width in the range of about 1 mm to about 3 mm; the narrow slit portion 28 of the air nozzle member has a width in the range of about 0.1 mm to about 0.3 mm; the width of discharge opening 14 relative to the width of slit 28 is preferably about 10 to 1; the slurry discharge opening 14 and the air discharge opening 27-28 have a length (the length being right-to-left in FIG. 2) of at least about 100 mm, and a preferred length of at least about 150 mm; and the tip end (i.e., the discharge end) of the air nozzle member 4 preferably projects downwardly into the converging channel 16 by a distance in the range of about 1 mm to about 3 mm.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an abrasive blasting system including a tank containing therein a liquid-solid abrasive particle slurry, a nozzle structure for discharging a stream of said slurry against a workpiece, means for supplying said slurry to said nozzle structure, and means for supplying pressurized air to said nozzle structure for blasting said slurry therefrom in the form of an air-slurry stream, the improvement wherein said nozzle structure comprises:

body means defining therein an elongated slurry flow passage extending along a first direction, said body means defining therein inlet and outlet openings communicating with opposite ends of said slurry flow passage for respectively permitting the slurry to flow therethrough;

said body means defining therein an elongated air passage which is spaced upwardly from said slurry flow passage and extends in generally parallel relationship therewith, and an air inlet formed in said body means in direct communication with said air flow passage for permitting the pressurized air to be supplied thereto, said air inlet being oriented in generally perpendicular relationship with respect to a second direction which perpendicularly intersects the longitudinally extending central axes of said slurry and air supply passages;

first nozzle means stationarily associated with said body means and defining a slitlike discharge opening for permitting ejection of a thin curtainlike air-slurry jet, said slitlike discharge opening extending downwardly away from said slurry flow passage substantially along said second direction so as to be substantially perpendicular with respect to said first direction, said discharge opening being continuously open and having an upstream end which communicates with said slurry passage and a downstream discharge end which is spaced a substantial sideward distance from said slurry passage, said discharge opening being substantially elongated in said first direction so as to have a length dimension as measured along said first direction which substantially exceeds the length as measured along said second direction, said discharge opening as it extends along said second direction between said upstream and discharge ends being of substantial length and of narrow width throughout said last-mentioned length;

said first nozzle means also including structure defining an elongated V-shaped channel extending longitudinally along said slurry passage, said V-shaped channel extending directly along the lower side of said slurry passage and opening upwardly for continuous communication with said slurry passage, said discharge opening having the upstream end thereof communicating with said V-shaped channel substantially at the apex thereof;

second nozzle means stationarily mounted relative to said body means and defining a slitlike air opening which projects substantially along said second direction in alignment with said discharge opening, said second nozzle means projecting downwardly along said second direction away from said air supply passage and substantially transversely across said slurry passage so as to terminate in a lower tip part which projects downwardly into said V-shaped channel, said slitlike air opening at its upper end having an inlet which communicates with said air passage and at its lower end an outlet which opens downwardly through said lower tip part, said outlet being directed downwardly toward said apex so as to be aligned with and disposed directly opposite the upstream end of said discharge opening, said outlet being spaced upwardly from the upstream end of said discharge opening by a small distance, and said slitlike air opening having a length as measure in said first direction which is similar in magnitude to the length of said slitlike discharge opening as measured in said first direction;

whereby a thin curtainlike jet of air is discharged from said air opening into said V-shaped channel directly adjacent the upstream end of said discharge opening for causing the slurry in the channel to be entrained within the curtainlike air jet and then transported through and discharged out of said discharge opening;

wherein said body means includes a main body part having said slurry passage extending longitudinally therethrough and terminating in said inlet and outlet openings which are formed in opposite ends of said main body part, said main body part having a first slotlike opening which opens upwardly from the bottom thereof for communication with said slurry passage and a second slotlike opening which opens downwardly from the top thereof for communication with said slurry passage, said first and second slotlike openings being aligned with one another;

said first nozzle means including a pair of substantially identical first members positioned in opposed abutting engagement with one another for defining said slitlike discharge opening therebetween, said pair of opposed first members being stationarily disposed within said first slotlike opening, said pair of opposed first members having upper surfaces which are provided with tapered walls formed on the upper corners thereof for defining said V-shaped channel therebetween;

said body means including a top body part which removably and sealingly attaches to the top of said main body part, said top body part having said air supply passage extending longitudinally therethrough and terminating in openings which project through opposite end walls of said top body part; and said second nozzle means being clampingly held between said main and top body parts and being defined by an opposed pair of substantially identical second members which are disposed in opposed face-to-face contact with one another and define said slitlike air opening therebetween, said pair of opposed second members being stationarily disposed within said second slotlike opening.

2. A system according to claim 1, wherein said second nozzle means is generally T-shaped in cross section and includes at its upper end a sidewardly extending head part which is accommodated within a recess formed in the top of said main body part so that said head part is clampingly and sealingly held between said main body part and said top body part.

3. A system according to claim 2, wherein said body means includes a lower body part removably attached to said main body part for retaining said first nozzle means within said first slot-like opening.

* * * * *